US009697963B2

(12) United States Patent
Zwirglmaier et al.

(10) Patent No.: US 9,697,963 B2
(45) Date of Patent: Jul. 4, 2017

(54) ON-LOAD TAP CHANGER

(71) Applicant: Maschinenfabrik Reinhausen GmbH, Regensburg (DE)

(72) Inventors: Hubert Zwirglmaier, Regensburg (DE); Joerg Atmanspacher, Rinchnach (DE); Andreas Freisberg, Regensburg (DE); Gerhard Felixberger, Regensburg (DE); Johann Jobst, Regenstaut (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/899,575

(22) PCT Filed: Jun. 24, 2014

(86) PCT No.: PCT/EP2014/063262
§ 371 (c)(1),
(2) Date: Dec. 18, 2015

(87) PCT Pub. No.: WO2015/007477
PCT Pub. Date: Jan. 22, 2015

(65) Prior Publication Data

US 2016/0155580 A1 Jun. 2, 2016

(30) Foreign Application Priority Data

Jul. 16, 2013 (DE) ..... 10 2013 107 558

(51) Int. Cl.
*H01H 9/00* (2006.01)
*H01H 3/30* (2006.01)
(Continued)

(52) U.S. Cl.
CPC ..... *H01H 9/0033* (2013.01); *H01H 3/3052* (2013.01); *H01H 3/40* (2013.01); *H01H 3/44* (2013.01)

(58) Field of Classification Search
CPC ..... H01H 9/0016; H01H 2009/0022; H01H 9/0027; H01H 9/0044; H01H 9/0038;
(Continued)

(56) References Cited

U.S. PATENT DOCUMENTS 4,978,815 A 12/1990 Berger
5,107,200 A 4/1992 Dohnal
(Continued)

FOREIGN PATENT DOCUMENTS

DE 7408122 U 11/1974
DE 4231353 A 4/1993
DE 102007004530 A 9/2007

*Primary Examiner* — Edwin A. Leon
(74) *Attorney, Agent, or Firm* — Andrew Wilford

(57) ABSTRACT

The invention relates to an on-load tap-changer (1) having a switching tube (15), an energy accumulator (13) for adjusting a switch position of the switching tube (15), a detector (200) for detecting a switch position of the on-load tap-changer (1), and an on-load tap-changer mechanism (100). The switching tube (15) and the detector (200) are both mechanically coupled to the energy accumulator (13) via the on-load tap-changer mechanism (100).

9 Claims, 8 Drawing Sheets

(51) Int. Cl.
*H01H 3/40* (2006.01)
*H01H 3/44* (2006.01)

(58) Field of Classification Search
CPC ..... H01H 3/3052; H01H 9/0033; H01H 3/44; H01H 3/40; F16H 19/02; Y10T 74/18792; H02K 11/0042; H02K 7/1166; H02K 7/1004
USPC ..... 200/11 TC, 571, 275, 61.54, 504, 11 G; 218/147; 333/107, 262; 338/215; 336/127, 65, 137, 146–150, 141, 142; 322/71; 323/255, 256, 341, 342, 323/355–359; 29/622; 251/147
See application file for complete search history.

(56) References Cited

U.S. PATENT DOCUMENTS

| | | | | |
|---|---|---|---|---|
| 5,834,717 | A | 11/1998 | Neumeyer | |
| 6,087,607 | A | 7/2000 | Dohnal | |
| 6,307,283 | B1 | 10/2001 | Dohnal | |
| 8,119,939 | B2 | 2/2012 | Albrecht | |
| 8,947,188 | B2 * | 2/2015 | Hammer | H01F 29/04 218/10 |
| 2009/0000927 | A1 | 1/2009 | Albrecht | |
| 2014/0159847 | A1 * | 6/2014 | Wrede | H02P 13/06 336/150 |

* cited by examiner

ON-LOAD TAP CHANGER

CROSS REFERENCE TO RELATED APPLICATIONS

This application is the US-national stage of PCT application PCT/EP2014/063262 filed 24 Jun. 2014 and claiming the priority of German patent application 102013107558.4 itself filed 16 Jul. 2013.

FIELD OF THE INVENTION

The invention relates to an on-load tap changer. The on-load tap changer according to the invention comprises a switching tube, a force-storing unit for setting a switch setting of the switching tube, a detector for detecting a switch setting of the on-load tap changer and an on-load tap changer transmission. The on-load tap changer transmission mechanically couples the force-storing unit with the switching tube.

BACKGROUND OF THE INVENTION

On-load tap changers (in abbreviation OLTC) are widely known and customary in the prior art. They serve for uninterrupted switching over between different winding taps of tapped transformers. On-load tap changers are divided into load selectors and load changeover switches.

Both kinds of on-load tap changers are actuated by a motor drive (preferably electric motor) for the switching over. A drive output or drive input shaft that draws up a drive element of the on-load tap changer, is moved by the motor drive. This drive element produces, for example, movement of a switching tube of the on-load tap changer and is usually termed force-storing unit (or also power store). When the force-storing unit is fully loaded, i.e. stressed, it is unlatched, abruptly releases its energy and actuates in a time period of milliseconds (ms) a switching tube that then executes a specific switching sequence during the load changeover. In that case, different switch contacts and resistance contacts are actuated in a specific time sequence. The switch contacts serve for direct connection of the respective winding tap with the load diverter and the resistance contacts for temporary connection, i.e. bridging over, by means of one or more switch-over resistances. Advantageously, vacuum interrupters are used as switch elements for the load changeover. This is based on the fact that the use of vacuum interrupters for the load changeover prevents arc formation in the oil and thus oil contamination of the load changeover switch oil, such as, for example, described in German Patent Specifications DE 195 10 809 [U.S. Pat. No. 5,834,717] and DE 40 11 019 [U.S. Pat. No. 5,107,200] and German published specifications DE 42 31 353 and DE 10 2007 004 5.

International Patent Application WO 1998/038661 discloses a motor drive for step switches, tap changers or plunger coils. The motor drive serves particularly for setting the step switch to the respectively desired switch setting. In the motor drive, all mechanical and electrical subassemblies required for drive of the step switch are combined together.

Based on that, a step switch of the reactor switch type is described in International Patent Application WO 2004/088693 [U.S. Pat. No. 7,463,010]. This similarly comprises a motor drive with downstream transmission, particularly a Geneva wheel transmission or lever deflecting transmission.

Chinese Utility Model CN 201242930Y discloses an on-load tap changer head for an on-load tap changer for uninterrupted switching over between different load step settings. The on-load tap changer head comprises an on-load tap changer transmission and a mechanical load step setting indicating means. For this purpose, an indicator shaft of the load step setting indicating means is directly coupled to a transmission shaft of the on-load tap changer transmission. The on-load tap changer head is provided with a cover with a viewing window through which the load step setting indicating means is readable. In particular, end setting mechanisms are provided so that the on-load tap changer cannot be connected beyond a start setting or end setting.

Chinese Utility Model CN 201167023Y discloses an on-load tap changer transmission with an indicating mechanism for switch-setting indicating means of an on-load tap changer. The on-load tap changer transmission comprises a transmission shaft with which a motor driving the switching tube of the on-load tap changer can be coupled. The transmission shaft drives a drive input shaft of the on-load tap changer transmission by a worm gear. A coupling element by which the drive input shaft is coupled with the switching tube of the on-load tap changer is formed at the lower side of an end of the drive input shaft remote from the motor. For indication of the switching position, an end of the indicating shaft projects from the housing of the on-load tap changer and is provided with a pointer rotatable relative to an indicating disk with switch setting marks. In order to improve readability, the pointer can be optically magnified.

A disadvantage of the on-load tap changer transmission with an indicating mechanism of Chinese Utility Model Specification CN 201167023Y is that the indicating mechanism records the movement of the drive input shaft for loading a force-storing unit. Derivation at the drive input shaft is susceptible to error, since possible slip between drive input shaft and force-storing unit is not detected, so that the indication of the switching position is imprecise.

OBJECT OF THE INVENTION

The object of the invention is to provide an on-load tap changer in which the switch settings of the on-load tap changer can be detected in a manner that is reliable, secure against manipulation and without susceptibility to error. In addition, the on-load tap changer shall be simple to maintain.

SUMMARY OF THE INVENTION

The invention on-load tap changer according to the invention comprises a switching tube and a force-storing unit for setting a switch setting of the switching tube. In addition, the on-load tap changer comprises a detector for detecting a switch setting of the tap changer and an on-load tap changer transmission. Both the switching tube and the detector are mechanically coupled with the force-storing unit by the on-load tap changer transmission.

Similarly, a preselector and optionally a fine selector of the on-load tap changer can each be mechanically coupled by the on-load tap changer transmission with the force-storing unit for setting a switch setting of the preselector and with the detector for detecting its switch setting. The switch setting of the on-load tap changer in this embodiment results from a combination of the setting of switching tube, preselector and optional fine selector. The on-load tap changer transmission transfers, for example, a combination of the movements of switching tube, preselector and optional fine selector into the detector.

In particular, the detector can detect a mechanical input signal coupled in by the on-load tap changer transmission and convert it into and output an electronic signal of the switch setting of the on-load tap changer. For example, an electronic circuit that further processes the electronic signal, for example amplifies and/or digitalizes it, can be provided in the detector.

The detector can comprise a cam-switching mechanism and/or transmitter system. In a special embodiment, the detector comprises a cam-switching mechanism consisting of at least one cam disk with a plurality of switch-setting positions and at least one lobe. The at least one lobe is detachably connectable at each switch-setting position. The cam disk of the detector serves for, for example, detection of end positions of the on-load tap changer. In particular, faulty switchings of the on-load tap changer can thus be avoided. For that purpose, the at least one switch for detecting an end position of the on-load tap changer can be associated with the at least one cam disk in such a way that each switch is actuatable by at least one lobe.

The actual detection of the switch setting of the on-load tap changer can take place by a transmitter system that is partly integrated on the cam disk. The transmitter system can be formed as, for example, Hall effect transmitters, optical transmitters or potentiometers. In a particular embodiment of the invention it comprises a plurality of wiper contacts and a wiper. At least one wiper contact that can be electrically coupled with a wiper, is formed at each switch-setting position of the at least one cam disk.

In fact, one cam disk according to the invention suffices for full detection of the end settings and switch settings of the on-load tap changer. However, for reasons of reliability the detector can be designed redundantly with a plurality of such cam disks. In that case, a wiper can be simultaneously electrically coupled with the wiper contacts of two cam disks.

The advantage of a cam disk of such modular construction is that the detector can be adapted, by simple shifting of lobes on the cam disk, to on-load tap changers with different numbers of switch settings. Moreover, the modular components of the detector are thus able to be standardized. This reduces costs for production and supply of replacement parts.

In addition, a detector housing for receiving the detector can be on a cover of the on-load tap changer. In particular, a housing cover can be detachably mounted so that the detector can be serviced or exchanged in simple manner without the cover of the on-load tap changer having to be demounted or the on-load tap changer transmission having to be removed.

In addition to the detector for detecting the switch setting of the on-load tap changer a movement detector can be provided. According to the invention the movement detector is associated with a drive input shaft, by which the force-storing unit can be loaded, of the on-load tap changer transmission. The movement detector can detect the rotation of the drive input shaft and convert it into and output it as an electronic signal. The drive input shaft is coupled, optionally by a motor transmission, to an electric motor or to a manual emergency actuating means. Detection of the rotation thereof makes it possible to monitor how the force-storing unit is loaded by the electric motor or the emergency actuating means.

The movement detector can be constructed as a transmitter system, for example as a cam-switching mechanism. The transmitter system can be constructed as an absolute value transmitter. Absolute value transmitters issue length or angle information of a device to be measured, in the form of an absolute, usually digitalized, numerical value. Since it is not necessary to refer to a reference, they can take up the measurement operation immediately after switching-on, which is of advantage for simple and reliable operation of the on-load tap changer according to the invention.

The detector, or the detector and the running detector, can be electrically connected with a controller for controlling or regulating the on-load tap changer. In particular, it is possible by the electrical signals of detector and optional movement detector to regulate the electric motor of the on-load tap changer that ultimately drives the electrical connecting of the on-load tap changer.

The inventive idea, which is realized in the present on-load tap changer, is based on derivation from the abrupt drive movement of the force-storing unit that actually acts on the switching tube and optional preselector, instead of from a continuous movement of the drive input shaft that loads the force-storing unit when it is not in operative connection with the switching tube. If the force-storing unit, for example, jams or—erroneously—is not completely loaded so that it is not triggered, then in an on-load tap changer of the prior art the indicated switch setting would depart from the actual switch setting. Previously, detection of the switch setting was based on the rotation of the drive input shaft. Drive input shaft and force-storing unit can move independently of one another. Thereagainst, according to the invention only a switch setting change actually actuated by the force-storing unit can be detected. This is ensured by, in particular, the special embodiment of the rotation translator of the on-load tap changer transmission. The rotation translator comprises a follower and a cam driver for coupling a movement of the force-storing unit respectively into the detector and the switching tube. The follower and cam driver are rigidly coupled together. It is thereby ensured that the force-storing unit always acts simultaneously on the detector and switching tube. The movement of the force-storing unit is transferred by a respective mechanical transfer mechanism of the on-load tap changer transmission to the detector and the switching tube. The components of these transfer mechanisms can be of stable, compact and slip-free construction. Moreover, they lie within the interior of the on-load tap changer so as to be protected from environmental influences. As a result, the entire on-load tap changer transmission is exposed to the same temperature range so that thermally induced mechanical play or distortions is or are avoided.

A significant advantage of the invention resides primarily in the simple coupling integrated in the on-load tap changer transmission, of the detector for detecting the switch setting of the on-load tap changer. Existing solutions of the prior art thereagainst are simulated by the on-load tap changer transmission in the motor transmission coupled therewith, of the electric motor. The coupling process connected therewith and the synchronisation of the electric motor and the on-load tap changer are in that case very complicated and susceptible to fault. If indicated and actual switch positions deviate, an erroneous coupling and switching process can lead to failure of the end setting limitations. According to the invention this is excluded. The simplification according to the invention substitutes a control transmission necessary for this coupling process. If a linkage or a shaft in the control transmission breaks, moreover, this cannot be immediately recognized because the indicated and actual switch setting deviate. In addition, for constructional reasons the movement often has to take place over lengthy paths. The longer this path is, the greater the tendency to mechanical play that can falsify the switch setting. Furthermore, such an indirect control transmission is connected with additional costs that in accordance with the invention are eliminated.

A further advantage of the invention is that the electric motor can be demounted for, for example, normal maintenance work without it being necessary to intervene in the mechanical coupling between detector of the on-load tap changer transmission and the switching tube. As a result, the indicated and actual switching positions of the tap changer cannot deviate. At the time of installation of the electric motor a complicated re-calibration of indicated and actual switch settings is not needed.

BRIEF DESCRIPTION OF THE DRAWING

The invention and advantages thereof are explained in more detail in the following with reference to the accompanying drawings, in which.

SPECIFIC DESCRIPTION OF THE INVENTION

Figure 1:
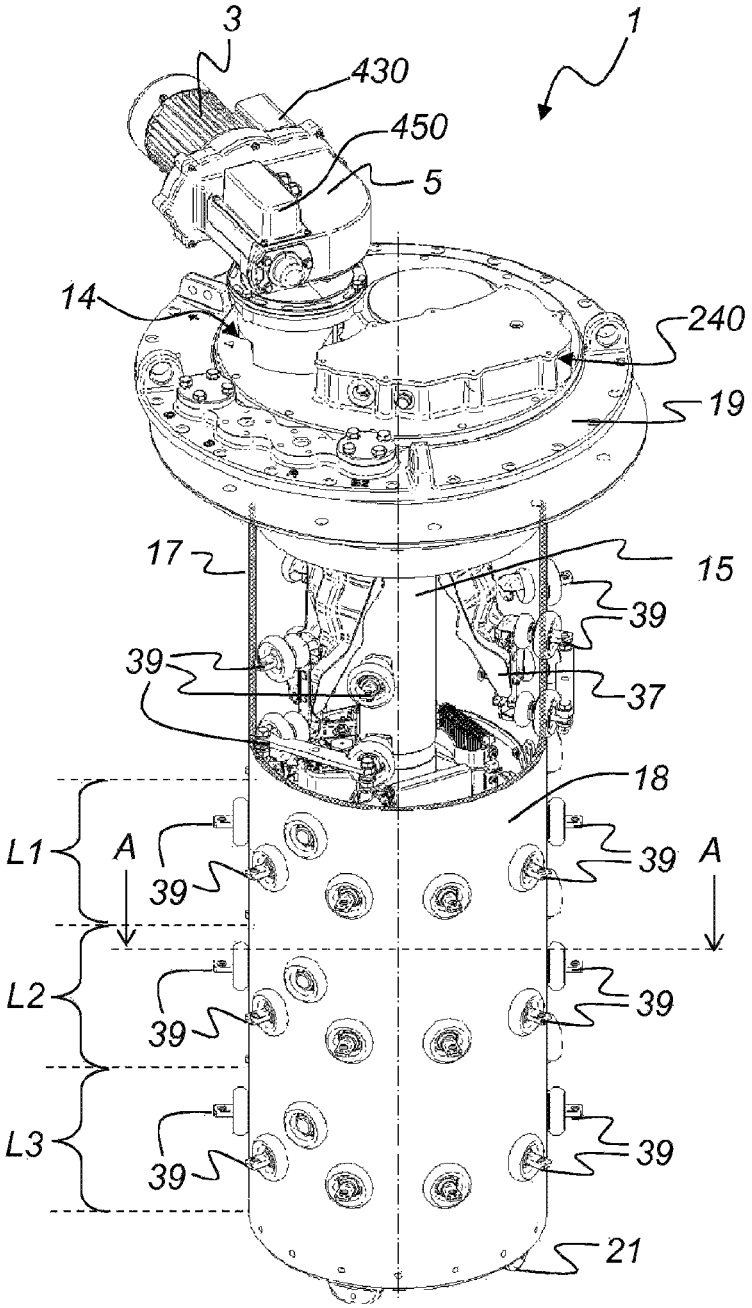
FIG. 1 is a perspective view of an on-load tap changer according to the invention in an embodiment of a three-phase load selector with preselector.

Identical reference numerals are used for the same or equivalent elements of the invention. For the sake of clarity, only reference numerals are illustrated that are necessary for description of the respective figure. The embodiments that are illustrated by example, of the on-load tap changer according to the invention do not represent a restriction of the scope of protection defined by the claims, for the invention.

FIG. 1 is a perspective view of an on-load tap changer according to the invention in the form of a three-phase load selector 1. The load selector 1 here comprises, as drive, an electric motor 3 with a transmission 5 that loads a force-storing unit (not illustrated). When the force-storing unit is fully loaded, i.e. stressed, it is unlatched, abruptly releases its energy and actuates a switching tube 15. The rotating switching tube 15 is rotatable in the oil tank 18 so that different switching positions can be set. The oil tank 18 is closed upwardly by a cover 19 and additionally carries a base 21.

The load selector 1 according to the invention has three phases L1, L2, L3 that are one above the other in the oil tank 18. A preselector 37 is mounted on the switching tube above the three phases L1, L2, L3. Electrical terminal elements 39 are in that case so positioned at the load selector 1 that they pass through a wall 17 of the oil tank 18.

Figure 2:
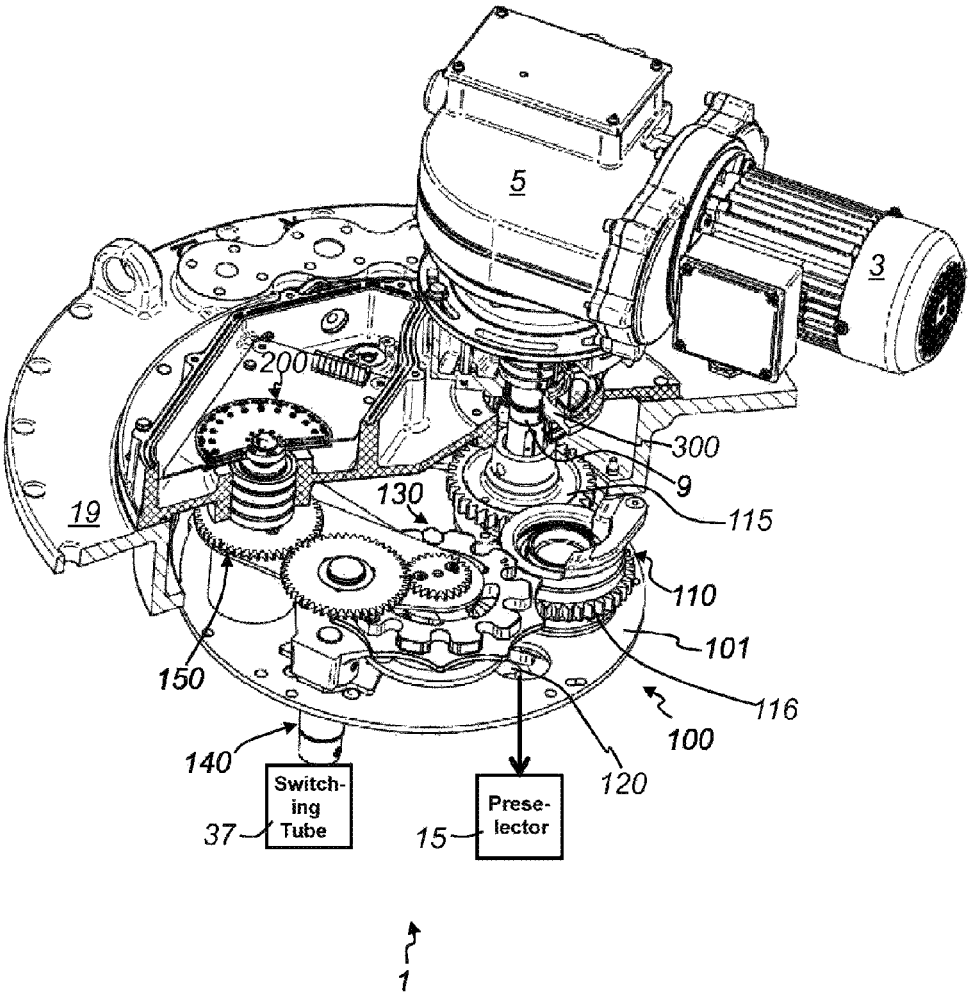
FIG. 2 is a perspective view of the on-load tap changer transmission of the on-load tap changer according to the invention.

FIG. 2 is a perspective view of the on-load tap changer transmission 100 of the on-load tap changer 1 according to the invention. The on-load tap changer transmission 100 is on a mounting plate 101 that is detachably connected with the sectionally illustrated cover 19 of the on-load tap changer 1. A drive input shaft 9 is coupled with an electric motor 3 by a motor transmission 5. The drive input shaft 9 drives a rotation translator 110 in order to load a force-storing unit 13 (see FIG. 5) coupled with the rotation translator 110. In that case the drive input shaft 9 typically executes half a revolution. A full revolution of the drive input shaft 9 is equally conceivable. As soon as the force-storing unit 13 is fully loaded it is unlatched and produces a rotation of the rotation translator 110. The rotation translator 110 on the one hand drives a Geneva wheel 120, with which the switching tube 15 and, via a preselector driver 140, a preselector 37 are connected. Through a suitable mechanical translation, the switching tube 15 in that case rotates through, for example, an angle of 30° per switching process. The preselector is, for example, switched from a 'plus position' via a 'zero position' to a 'minus position'. On the other hand, the rotational translator 110 drives a rotation pick-up 130 that in turn drives an indicator driver 150. The indicator driver 150 causes a rotation in the detector 200 of, for example, a twentieth of a revolution per 30° rotation of the switching tube 15. In addition, the preselector driver 140 couples the switching movement of the preselector 37 into the rotation pick-up 130 that similarly acts by the indicator driver 150 on the detector 200. This action can consist of, for example, the rotational sense of the twentieth of a revolution produced by the switching tube 15, in the detector 200 being reversed. Depending on the respective design of the transmission it can be necessary to switch the switching tube 15 to a defined switch-setting position 201, 202 or 203 before the preselector 37 is connectable. This can be an additional 'zero position' of the switching tube 15. Thus, by the on-load tap changer transmission 100 the switching movements of the switching tube 15 and the preselector 37 can be simultaneously coupled into the detector 200 and detected. Both the setting of the switching tube 15 and that of the preselector 37 are included in the thus-detectable switch setting of the on-load tap changer 1. If the switching tube 15 has, for example, eight switch settings and the zero position and the preselector 37 has a 'plus position' and a 'minus position' then a total of 19 switch settings that can be represented on the detector 200 as, for example, '−8, −1, 0, +1, . . . , +8', arise for the entire on-load tap changer 1. In that case, for example, the switch setting '−3' denotes that the preselector 37 is in 'minus position' and the switching tube in the third of eight switch positions. Analogously to the preselector 37, a fine selector (not illustrated) can also be included in the switch setting detection by the on-load tap changer transmission 100.

The force-storing unit 13 is loaded by a drive input shaft 9 by the electric motor 3. When it is completely loaded, it is unlatched so that it rapidly returns to its rest position. In that case the on-load tap changer transmission 100 couples the force-storing unit 13 in such a way to the switching tube 15 that at least a part of its movement energy is translated into a rotation of the switching tube 15. At the same time, the on-load tap changer transmission 100 couples the force-storing unit 13 in such a way to the detector 200 that it records a movement. The movement recorded by the detector 200 is correlated with the rotation of the switching tube 15 by the on-load tap changer transmission 100 and consequently is a measure for the rotation of the switching tube. For example, an indicator shaft 151 connected with the detector 200 rotates through an angle of 5° when the switching tube rotates through 30°. Preferably, the drive input shaft 9 is, at the time of unlatching, decoupled from the force-storing unit 13 and on attainment of the rest position of the force-storing unit 13 is coupled again so that the drive input shaft 9 does not execute a movement in opposite sense to the relaxing force-storing unit 13. Alternatively, the coupling between force-storing unit 13 and its drive input shaft 9 can also be maintained and merely the electric motor 3 switched to be free of current so that it can be co-rotated by the force-storing unit 13 with little expenditure of energy.

Figure 3:
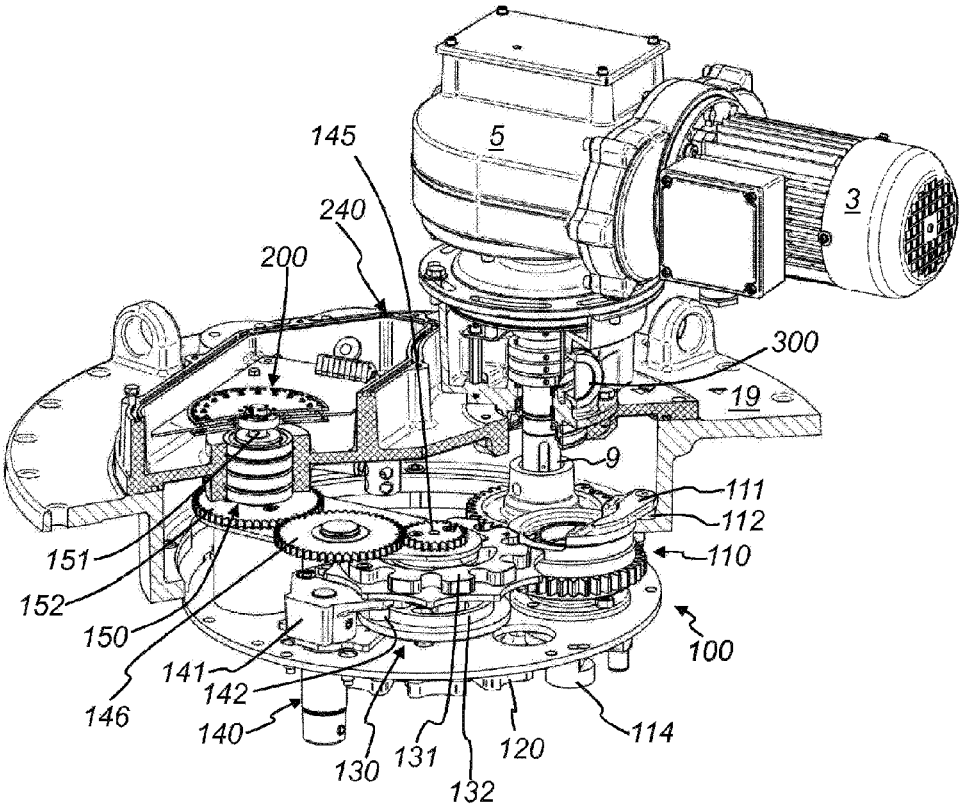
FIG. 3 is a further perspective view of the on-load tap changer transmission of the on-load tap changer according to the invention.
Figure 4:
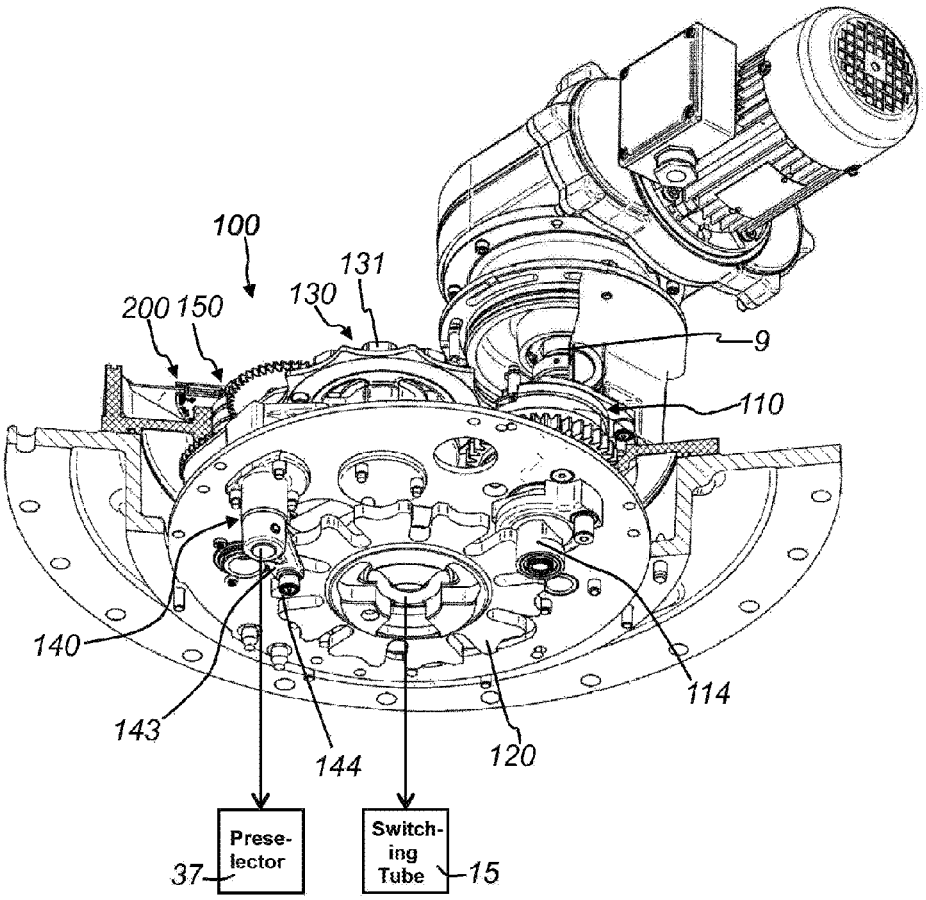
FIG. 4 is a perspective view from below of the on-load tap changer transmission of the on-load tap changer according to the invention.
Figure 5:
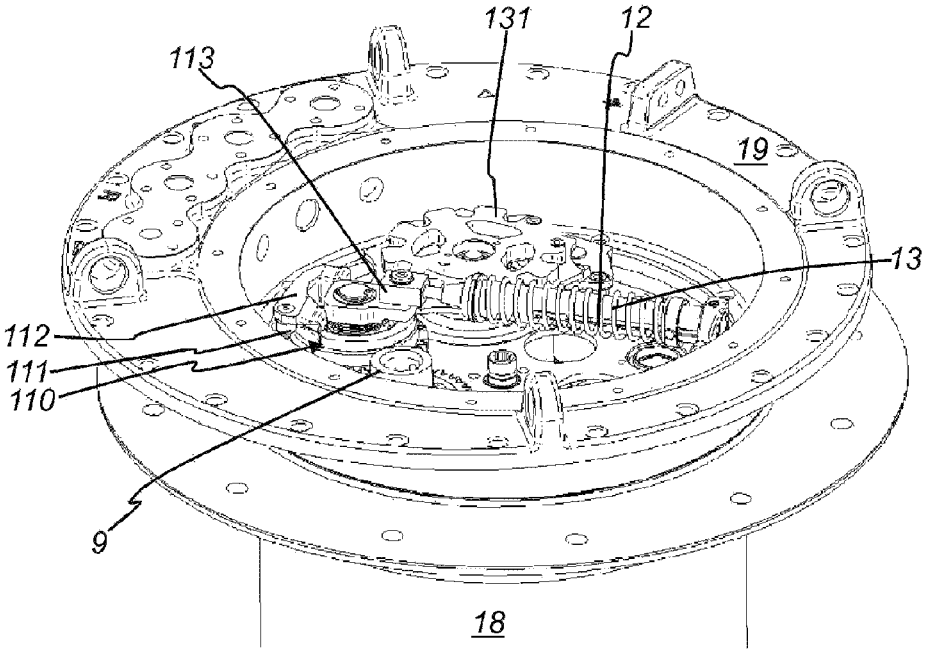
FIG. 5 is a further perspective view of the upper part of the on-load tap changer in which the installed force-storing unit is visible.

FIGS. 3, 4 and 5 show different perspective views of the on-load tap changer transmission 100 of the on-load tap changer 1. For the sake of clarity the force-storing unit 13 is illustrated only in FIG. 5.

The drive input shaft 9 of the on-load tap changer transmission 100 is driven by an electric motor 3 via a motor housing 5. A drive input shaft gear 115 of the drive input shaft 9 drives a crank 113 of the rotation pick-up 110 by a rotation pick-up gear 116 of the rotation pick-up 110. The crank 113 stresses the force-storing unit 13. As soon as the crank 113 has fully loaded the force-storing unit 13, it is automatically unlatched by the drive input shaft gear 115 of the drive input shaft 9 and driven by the force-storing unit 13. The unlatched crank 113 drives the rotation translator 110. The rotation translator 110 on the one hand drives a first cam disk 131 of a rotation pick-up 130 by a first follower 111 with a first follower wheel 112 and on the other hand drives a Geneva disk 120 by a Geneva driver 114. The Geneva disk 120 on the one hand drives a switching tube 15 of the on-load tap changer 1 and on the other hand a preselector driver 150 for driving a preselector 37 of the on-load tap changer 1. The preselector driver 150 drives a second cam disk 132 of the rotation pick-up 130 by a second follower 141 with a second follower wheel 142. A rotation pick-up gear 145 of the rotation pick-up 140 drives, directly or by an intermediate gear 146, an indicator shaft gear 152 that is seated on an indicator shaft 151 to be axially and rigidly connected, so that a rotation of the indicator shaft 151 is produced. The indicator shaft 150 is mechanically coupled with the detector 200. The rotation of the indicator shaft 151 is detected by the detector 200 and converted into and output as an electrical signal. In addition, a movement detector 300 is at the drive input shaft 9. The movement detector is constructed as, for example, a transmitter system or cam-switching mechanism and detects the rotation of the drive input shaft 9 and thus, indirectly by the motor transmission 5, the drive movement of the electric motor 3.

Figure 6:
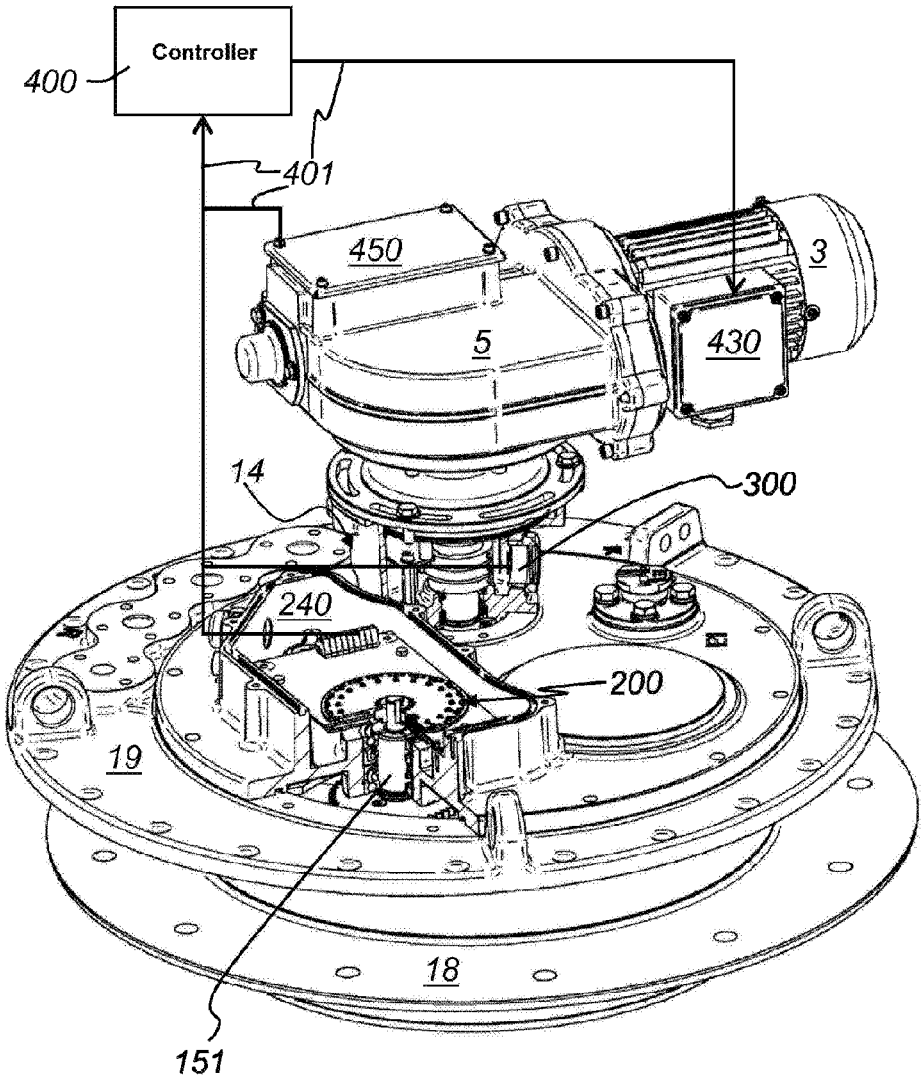
FIG. 6 is a perspective view of the cover of the on-load tap changer according to the invention of FIG. 1 in which a controller is illustrated.

FIG. 6 is a perspective view of the cover 19 of the on-load tap changer 1 and the connection thereof with a controller 400. The indicator shaft 151 is led through an opening (not illustrated) in the cover 19 so that the detector 200 can be on the cover 19. A detector housing 240 for receiving the detector 200 is formed on the cover 19. The detector housing 240 is closable and openable by a detector housing cover 241 (see FIG. 1), so that the detector 200 can be easily accessed and in a given case exchanged without the cover 19 having to be demounted. Equally, the movement detector 300 is received in an intermediate housing 14. The detector 200, the movement detector 300, the electric motor 3 directly or a motor control 430 of the electric motor 3 and/or a transmission control 450 of the motor drive 50 are connected with a controller 400 for controlling and/or regulating the on-load tap changer 1. The controller 400 can regulate, for example, the electric motor 430 on the basis of the signals of the detector 200 and movement detector 300 in a regulating circuit.

Figure 7:
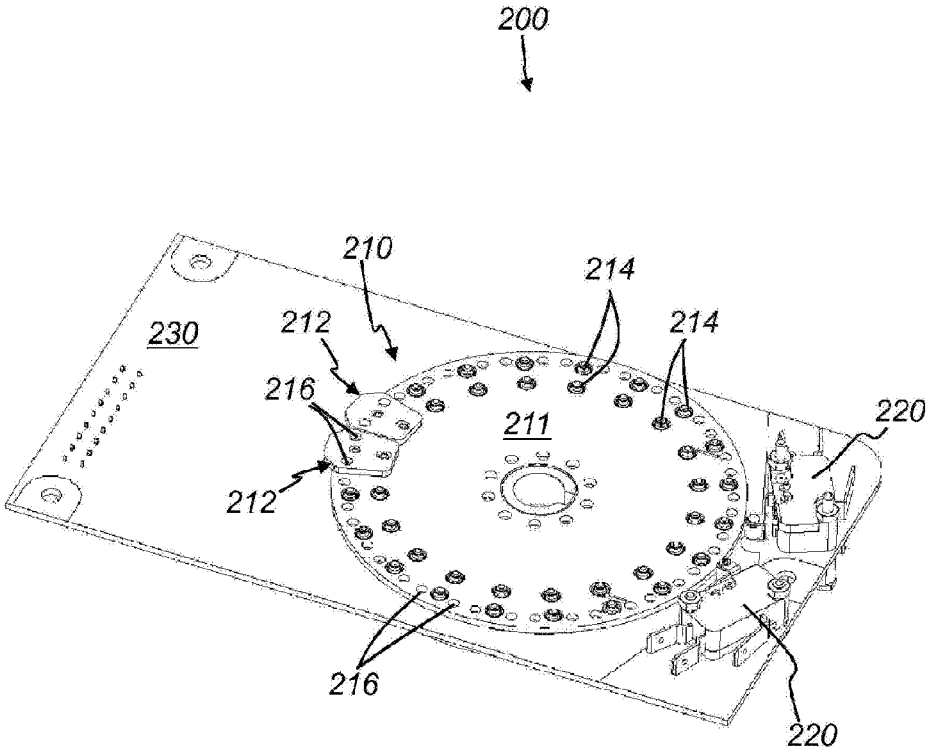
FIG. 7 is a perspective view of one embodiment of the detector for detecting the switch setting of the on-load tap changer.
Figure 8:
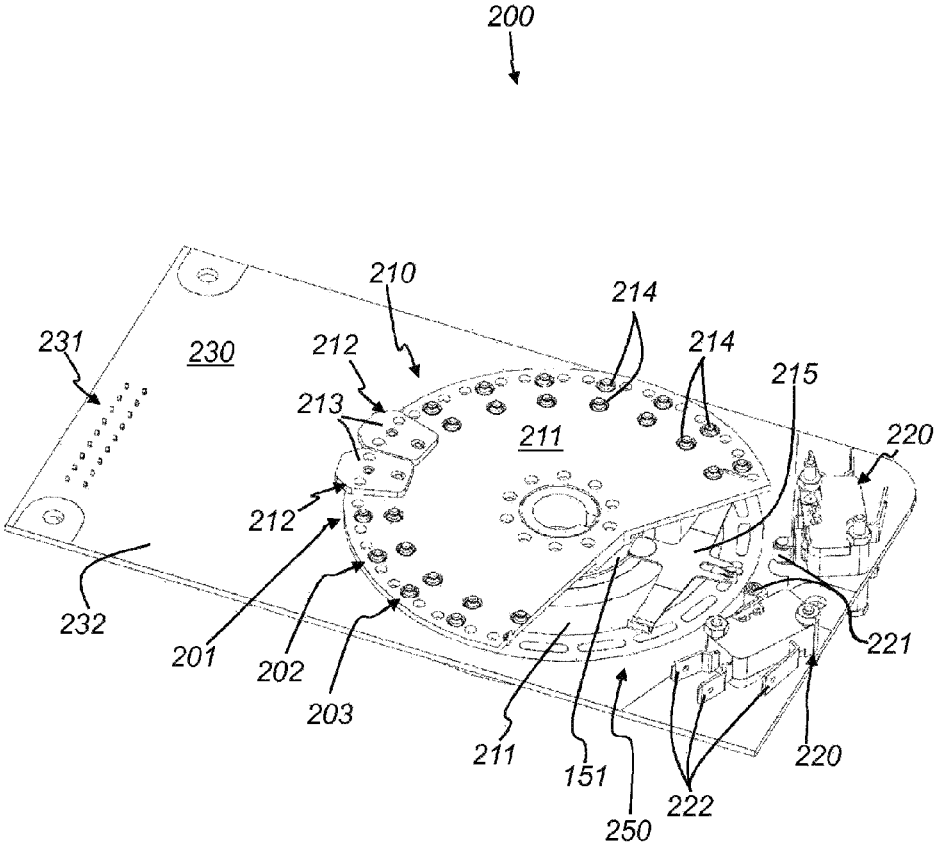
FIG. 8 is a sectional perspective view of the embodiment shown in FIG. 7, of the detector for detecting the switch setting of the on-load tap changer.

FIGS. 7 and 8 show a perspective view of one embodiment of the detector 200 for detecting the switch setting of the on-load tap changer 1 according to the invention. In FIG. 7 the cam disk 211 is illustrated in section. The detector 200 consists of an electronic circuit 230 with circuit contacts 231. The circuit 230 carries a cam-switching mechanism 210. This cam-switching mechanism 210 consists of at least one cam disk 211 with a plurality of switch-setting positions 201, 202, 203 and at least one lobe 212. The at least one lobe 212 is detachably connectable at each switch-setting position 201, 202, 203. A respective cam disk 211 is rotatably mounted on the upper side 232 and on the lower side (not able to be illustrated in this perspective view) of the circuit 230 and can be coupled with the indicator shaft 151 of the on-load tap changer transmission 100. This cam disk 211 executes, for example, a twentieth of a revolution per switching process of the switching tube 15. The rotational sense of this revolution is determined by means of the on-load tap changer transmission 100 from the setting of the preselector 37. At least one switch 220 for detecting an end position 201 of the on-load tap changer 1 is in that way associated with the at least one cam disk 211. Each switch 220 is in that way actuatable by at least one lobe 212.

In addition, the detector comprises a transmitter system 250. The transmitter system 250 comprises a plurality of wiper contacts 14 and a wiper 215 rigidly connected with the circuit. At least one wiper contact 214 that can be electrically coupled to the wiper 215, is formed at each switch-setting position 201, 202, 203 of the at least one cam disk 210. In principle, one cam disk 211 according to the invention is sufficient in the detector 200 in order to detect the switch setting of the on-load tap changer 1. However, for reasons of reliability the detector 200 is redundantly provided with the second and possibly further cam disks 211. A wiper 215 can be associated with two adjacent cam disks 211. The electronic circuit 230 can, for example, further process the switch-setting positions 201, 202, 203 that are detected by the detector 200, into an electronic signal, for example, amplify and/or digitalize them.

It will obvious to the expert that the device features of the embodiments described in the preceding can be used individually and in combination with one another in an on-load tap changer according to the invention in accordance with the following claims without departing from the scope of protection they define.

The invention claimed is:

1. An on-load tap changer comprising:

a switching tube, a force-storing unit for setting a switch setting of the switching tube, a detector for detecting the switch setting of the on-load tap changer and for outputting an electronic signal indicating the switch setting of the on-load tap changer, an on-load tap changer transmission that mechanically couples the force-storing unit to the switching tube, and a mechanical coupling between the force-storing unit and the on-load tap changer transmission.

2. An on-load tap changer comprising:

a switching tube, a force-storing unit for setting a switch setting of the switching tube, a detector for detecting the switch setting of the on-load tap changer, an on-load tap changer transmission that mechanically couples the force-storing unit to the switching tube, and a mechanical coupling between the force-storing unit and the on-load tap changer transmission; and a preselector of the on-load tap changer mechanically coupled by the on-load tap changer transmission with the force-storing unit for setting the switch setting of the preselector and with the detector for detecting the switch setting.

3. The on-load tap changer according to claim 1, wherein the detector comprises a cam-switching mechanism or transmitter system.

4. An on-load tap changer comprising:

a switching tube, a force-storing unit for setting a switch setting of the switching tube, a detector for detecting the switch setting of the on-load tap changer and having at least one cam disk having a plurality of switch-positions and at least one lobe effective at each switch-setting position, an on-load tap changer transmission that mechanically couples the force-storing unit to the switching tube, and a mechanical coupling between the force-storing unit and the on-load tap changer transmission.

5. The on-load tap changer according to claim 4, further comprising:

respective switches for detection of end positions of the on-load tap changer and so associated with the at least one cam disk that each switch is actuatable by at least one lobe.

6. The on-load tap changer according to claim 4, wherein the detector has a transmitter system provided with a plurality of wiper contacts and respective wipers each electrically connectable with the respective wiper and provided at a respective switch-setting position of the at least one cam disk.

7. The on-load tap changer according to claim 1, further comprising:

a detector housing holding the detector and mounted on a cover of the on-load tap changer.

8. The on-load tap changer according to claim 1, further comprising:

a movement detector for detecting rotation of a drive input shaft of the on-load tap changer transmission for loading the force-storing unit and associated with the shaft so that rotation of the drive input shaft can be outputted as an electronic signal.

9. The on-load tap changer according to claim 1, further comprising:

a controller electrically connected with the detector for control with or without feedback of the on-load tap changer.

* * * * *